US006638201B1

(12) United States Patent
Dischler

(10) Patent No.: US 6,638,201 B1
(45) Date of Patent: Oct. 28, 2003

(54) CAM ACTION EXERCISE APPARATUS WITH ASYMMETRIC ENERGY MANAGEMENT

(75) Inventor: Louis Dischler, Spartanburg, SC (US)

(73) Assignee: Delphi Oracle Corp., Spartanburg, SC (US)

( * ) Notice: Subject to any disclaimer, the term of this patent is extended or adjusted under 35 U.S.C. 154(b) by 41 days.

(21) Appl. No.: 10/001,694

(22) Filed: Oct. 25, 2001

(51) Int. Cl.[7] ..... A63B 21/00
(52) U.S. Cl. ..... 482/132
(58) Field of Search ..... 482/140, 132, 482/126, 136, 137

(56) References Cited

U.S. PATENT DOCUMENTS

| | | | | |
|---|---|---|---|---|
| 2,821,394 A | | 1/1958 | Barbeau | |
| 3,403,906 A | * | 10/1968 | Burzenski | 482/132 |
| 3,708,164 A | | 1/1973 | Griffin | |
| 3,752,475 A | | 8/1973 | Ott | |
| 5,707,325 A | | 1/1998 | Chiou | |
| 5,921,901 A | | 7/1999 | Palacios | |
| 6,017,296 A | | 1/2000 | Tang et al. | |
| 6,146,318 A | * | 11/2000 | Kuo | 482/132 |
| 6,174,269 B1 | | 1/2001 | Eschenbach | |
| 6,254,518 B1 | * | 7/2001 | Yu | 482/132 |
| 6,354,983 B1 | * | 3/2002 | Lee | 482/132 |
| 6,409,639 B1 | * | 6/2002 | Kuo | 482/132 |

* cited by examiner

*Primary Examiner*—Nicholas D. Lucchesi
*Assistant Examiner*—L Amerson

(57) ABSTRACT

A compact push-pull exercise apparatus having a partial turn outer cam surface in contact with a random surface such as a floor, and one or more handles rotatably mounted to the cam rotational axis. The operator begins an exercise cycle in the kneeling position with hands on the handles and with arms generally near the vertical position. The operator pushes the apparatus forward to a stopping position with the operator nearly prone. During the first portion of the forward movement, gravitational energy is stored as the cam rotational axis is lifted. As the operator reverses the movement from the prone position to the kneeling position, gravitational energy is released during the first portion of the in-stroke to ease the return motion during the most difficult portion of the exercise cycle.

27 Claims, 7 Drawing Sheets

CAM ACTION EXERCISE APPARATUS WITH ASYMMETRIC ENERGY MANAGEMENT

FIELD OF THE INVENTION

The present invention relates generally to a push-pull exercise apparatus, and more particularly to a partial turn exercise wheel having a cam outer surface and asymmetric gravitational energy storage and return.

BACKGROUND OF THE INVENTION

Various roller devices have been designed to provide kneel-prone-kneel exercise. These devices, when employing assisted return to the kneeling position, may be characterized as spring, cam, or inclined plane types. Among the spring types are those described in U.S. Pat. No. 2,821,394 to Barbeau, U.S. Pat. No. 3,708,164 to Griffin, U.S. Pat. No. 3,752,475 to Ott, U.S. Pat. No. 5,707,325 to Chiou, U.S. Pat. No. 6,174,269 to Eschenbach, and U.S. Pat. No. 6,017,296 to Tang et al.

In U.S. Pat. No. 5,707,325, Ott describes the use of a cam in conjunction with a spring. As there is no irrotational stroke segments, the periphery of the cam must be at least equal the length of the longest stroke desired, resulting in greatly reduced workout effectiveness, as the rotational axis of the cam must then be elevated excessively to accommodate a circumference equal to or greater than the maximum desired stroke. An inclined plane type is described in U.S. Pat. No. 5,921,901 to Palaclos, who also adds an elbow rest trolley to the trolley/track kneel-prone-kneel method. None of the aforementioned patents discloses a combination of cam and roller or slider action to achieve asymmetric energy return.

SUMMARY OF THE INVENTION

The present invention provides a compact push-pull exercise apparatus having a partial turn outer cam surface in contact with a random surface such as a floor, and one or more handles rotatably mounted to the cam rotational axis. The operator begins an exercise cycle in the kneeling position with hands on the handles and with arms generally near the vertical position. The operator pushes the apparatus forward to a stopping position with the operator nearly prone. During the first portion of the forward movement, gravitational energy is stored as the cam rotational axis is lifted. During subsequent forward motion, the vertical displacement of the rotational axis from the random surface is unchanged. As the operator reverses the movement from the prone position to the kneeling position, gravitational energy is released during the first portion of the in-stroke to ease the return motion during the most difficult portion of the exercise cycle.

It is an object of the present invention, therefore, to provide a push-pull cam action exercise apparatus for use with a random surface.

It is another object of the invention to provide a cam action exercise apparatus having asymmetric energy management.

It is another object of the invention to provide a cam action exercise apparatus for use with a random surface having a rotational axis close to the random surface.

It is another object of at least one embodiment of the invention to provide a wheel for employment by an operator on a random surface, whereby abdominal and other muscle groups of the operator are effectively exercised by a repetitive kneel-prone-kneel routine, in which energy is absorbed during the first portion of the kneel-prone out-stroke, and returned during the first portion of the prone-kneel in-stroke.

It is another object of at least one embodiment of the invention to provide a cam action exercise apparatus having an out-stroke with a translation/rotation first portion and a translation/irrotation second portion, and an in-stroke with a translation/rotation first portion and a translation/irrotation second portion.

It is another object of at least one embodiment of the invention to provide a method of abdominal exercise for a operator, wherein gravitational energy is stored by vertical displacement of a cam axis during the first portion of the out-stroke of a kneel-prone-kneel exercise routine, and returned during the first portion of the in-stroke, and wherein substantially no gravitational energy is either stored or returned during the remainder of the exercise cycle.

BRIEF DESCRIPTION OF THE DRAWINGS

The above as well as other objects of the invention will become more apparent from the following detailed description of the preferred embodiments of the invention, when taken together with the accompanying drawings in which.

DETAILED DESCRIPTION OF THE PRESENTLY PREFERRED EMBODIMENTS

The drawings constitute a part of this specification and include exemplary embodiments of the invention, which may be embodied in various forms. It is to be understood that in some instances various aspects of the invention may be shown exaggerated or enlarged to facilitate an understanding of the invention. Specific details disclosed herein are not to be interpreted as limiting, but rather as a basis for the claims and as a representative basis for teaching one skilled in the art to employ the present invention in virtually any appropriately detailed system, structure or manner.

Herein, specific terms are used with the following meanings: "out-stroke" means a kneel-prone stroke accomplished by the operator from a kneeling position to a substantially prone position with the body rotated about the knees into a substantially horizontal (or slightly inclined) position, and with the arms also substantially horizontal and extended. The hands and/or wrists of the operator are supported by handles or other supports mounted to the rotational axis of the apparatus.

"In-stroke" means one prone-kneel stroke, returning the operator to the initial kneeling position.

"Exercise cycle" means one kneel-prone-kneel cycle, i.e., one out-stroke followed by one in-stroke.

"Asymmetric energy management" means the storage of gravitational energy during the first portion of an out-stroke, and return of the stored energy during the first portion of the in-stroke. During the second portion of either the in-stroke or the out-stroke, substantially no gravitational energy is either stored or released.

"Cam lobe" is a wheel having a cam surface and a rotational axis.

"Exercise angle" means the absolute value of the angle through which the cam lobe rotates during either an in-stroke or an out-stroke. It is preferred that the exercise angle is greater than about 90° and less than 360°, more preferably greater than 120° and less than 300°, and most preferably about 270°.

"Characteristic angle" of a cam lobe means the angle made between the tangent to a specific point on the cam surface (or projecting roller surfaces contacting the random surface) with the perpendicular to a line between the rotational axis and the specific point.

Figure 1:
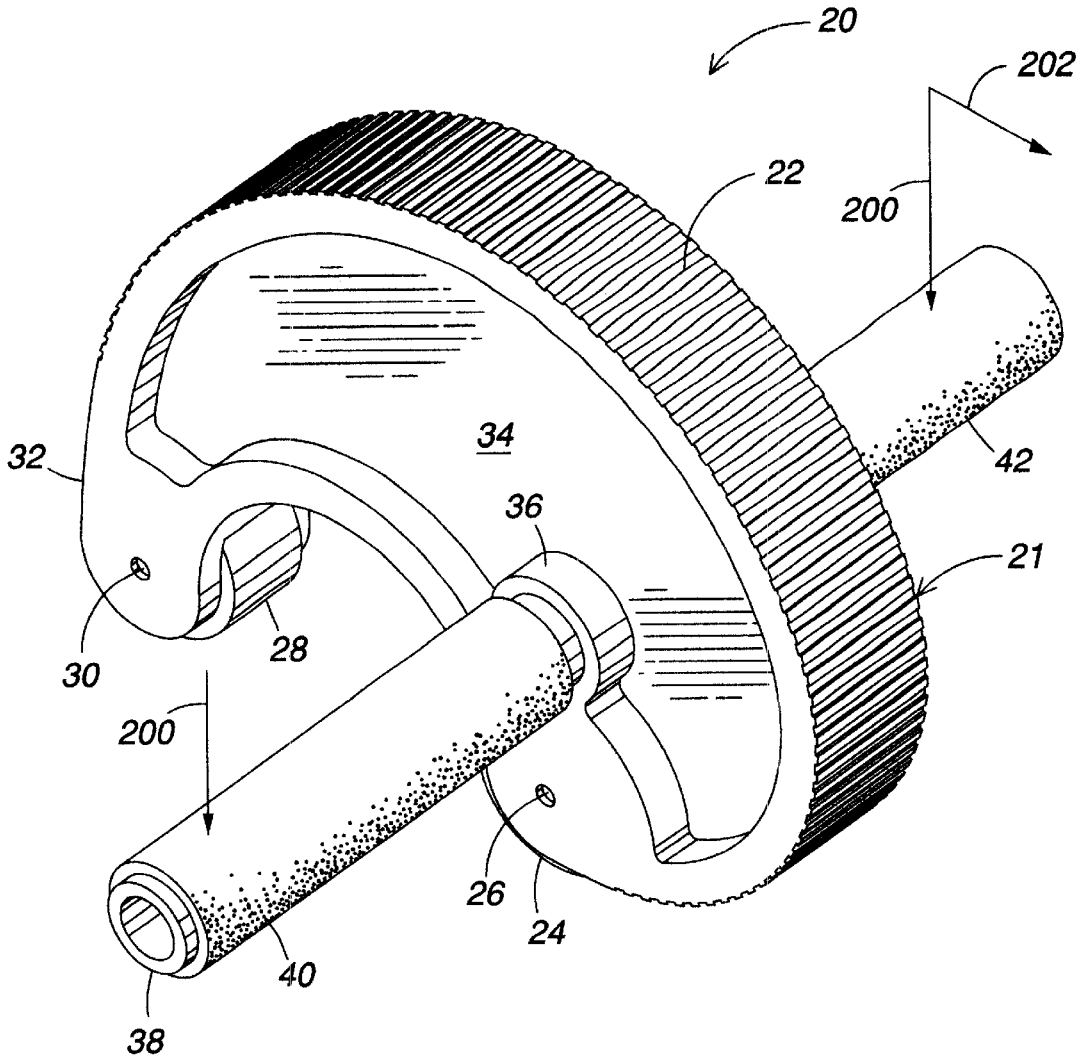
FIG. 1 is a perspective view of a cam action exercise apparatus according to a preferred embodiment of the invention.

Referring now to the drawings wherein like numerals refer to like parts, FIG. 1 illustrates a single lobed cam action exercise apparatus (the apparatus) generally indicated by numeral 20. Axle 38 provides support for handles 40, 42 for two handed operation. Monolithic cam lobe 21 may be alternatively divided into a plurality of spaced segments (not shown) along axle 38, and rotate as a unit. The weight of the operator is directed in direction 200. Axle 38 is free to rotate in bearing 36, which is part of monolithic cam lobe 21 comprised of cam friction surface 22, slide surface 32, and web 34. Axles 30, 26 support rollers 28, 24 respectively. With the weight of the operator vertically oriented in direction 200, the apparatus remains stationary in the initial position shown. When the apparatus 20 is pushed in forward direction 202, it begins to roll forward on cam friction surface 22.

Figure 2:
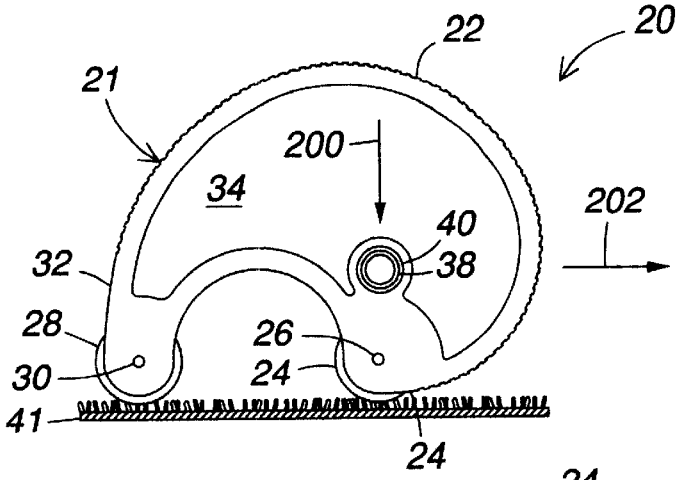
FIG. 2 is a side view of the cam action exercise apparatus shown in FIG. 1, with the apparatus in the initial position of the kneel-prone out-stroke.
Figure 3:
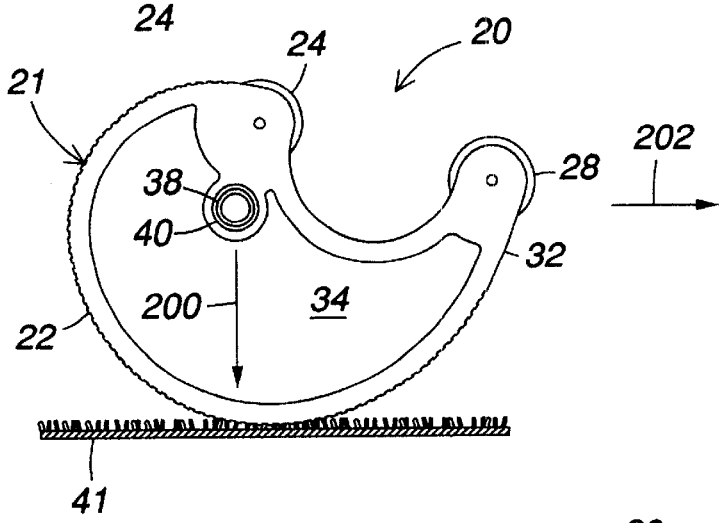
FIG. 3 is a side view of the cam action exercise apparatus shown in FIG. 2, with the apparatus in an intermediate position of the kneel-prone out-stroke.
Figure 4:
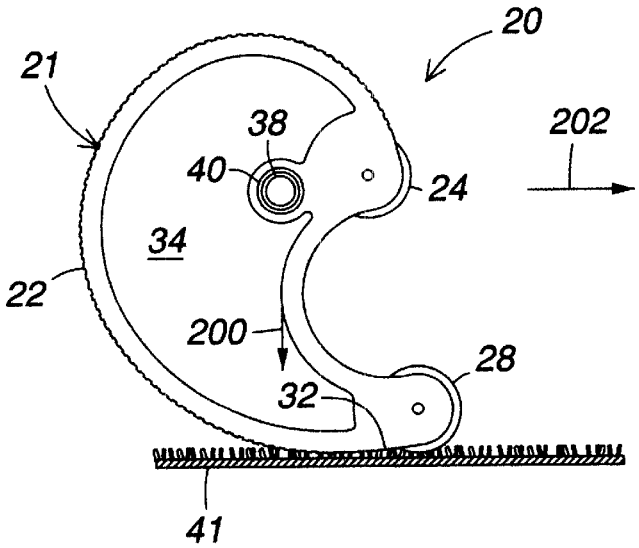
FIG. 4 is a side view of the cam action exercise apparatus shown in FIG. 2, with the apparatus in an final position of the kneel-prone out-stroke.

Turning now to FIGS. 2–4, the apparatus of FIG. 1 is shown at three positions during the exercise cycle. With part of the weight of the operator directed in direction 200, the apparatus 20 begins to roll about axle 38 in forward direction 202, as it is only semi-stable in this position. Cam friction surface 22, which may be covered with rubber, ribs, knurling, abrasive, or any other means for enhancing frictional interaction with the random surface, grips the random surface, shown here as carpet 41, and rotates so that the intermediate position shown in FIG. 3 is reached. With continued rotation, the final angular position of apparatus 20 is reached, as is shown in FIG. 4. In the first portion of the out-stroke, axle 38 rises and translates horizontally as the apparatus 20 rotates (FIGS. 2, 3). In the final portion of the out-stroke, axle 38 translates substantially parallel to random surface 41 as apparatus 20 translates horizontally without rotation (FIG. 4). In FIG. 4, apparatus 20 is supported in part by slide surface 32 and in part by roller 28.

During the in-stroke, the apparatus 20 in the (semi-stable) position shown in FIG. 4 reverts to the positions shown first in FIG. 3 and then finally in FIG. 2. During the first part of the in-stroke, the apparatus 20 immediately begins to roll on cam friction surface 22 (FIG. 4). In the final portion of the in-stroke (FIG. 2), the apparatus rolls on wheels 28, 24 to reach the initial starting position of the exercise cycle.

As is true for all of the embodiments herein, the first portion of both the in-stroke and the out-stroke is characterized by cam lobe rotational translation, with the final portion of both characterized by cam lobe irrotational translation.

Figure 5:
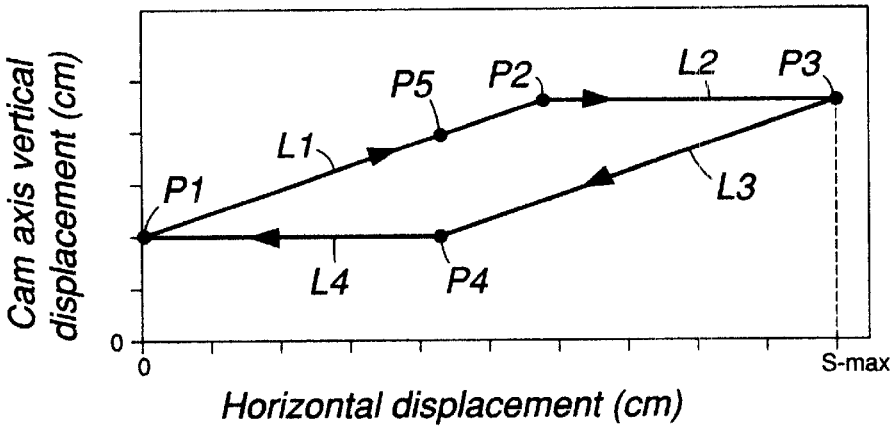
FIG. 5 is a plot of the horizontal and vertical displacements of the rotational axis as the apparatus is taken through a full exercise cycle.

Turning now to FIG. 5, an idealized plot of the cam axis vertical displacement from the random surface as the apparatus is displaced horizontally through an exercise cycle is shown. The starting and end points of the exercise cycle are shown identically as P1 (e.g., with the orientation of the apparatus 20 as shown in FIG. 2). During the first portion of the out-stroke L1, the cam lobe rotates and the vertical displacement increases, thereby storing gravitational energy. An intermediate point P5 corresponds to the apparatus 20 orientation of FIG. 3. Upon reaching P2, (e.g., the orientation of apparatus 20 as shown in FIG. 4), rotational of the cam lobe and further displacement of the cam lobe axis from the random surface ceases. It is preferred that P2 represent a vertical displacement of the axis from the random surface of at least 10% greater than that represented by P1, and more preferably at least 50% greater. During the final portion L2 of the out-stroke to the maximum stroke S-max, the cam lobe translates irrotationally from P2 to P3. During the first portion of the in-stroke L3, the cam lobe rotates and displacement of the cam axis from the random surface decreases until point P4 is reached. During the final portion of the in-stroke L4 (e.g., with the orientation of the apparatus 20 as shown in FIG. 2), rotation of the cam lobe and further displacement of the cam lobe axis towards the random surface ceases. Advantageously, a cycle can begin from a point other than P1 and end at a point other than P3 without any adjustment being made to the horizontal position or rotational orientation of the apparatus 20 for a subsequent cycle.

Figure 6:
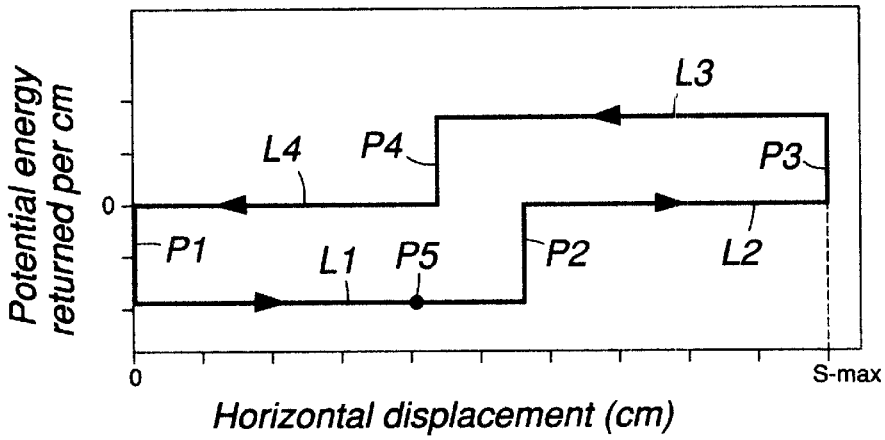
FIG. 6 is an idealized plot of the energy stored and returned by use of the apparatus of FIG. 1 as it is taken through a full exercise cycle.

Turning now to FIG. 6, an idealized plot of the gravitational energy returned per cm of horizontal displacement of the apparatus is shown. The starting and end points of the exercise cycle are shown identically as P1 (e.g., with the orientation of the apparatus 20 as shown in FIG. 2). During the first portion of the out-stroke L1, the apparatus 20 rotates and the vertical displacement increases, thereby storing gravitational energy (with potential energy/cm shown as an arbitrary negative quantity). An intermediate point P5 corresponds to apparatus 20 orientation of FIG. 3. Upon reaching P2, (e.g., the orientation of apparatus 20 as shown in FIG. 4), rotational of the apparatus 20 and further displacement of the axis of axle 38 from the random surface ceases. During the final portion of the out-stroke L2 to the maximum stroke S-max, the apparatus 20 translates irrotationally to the final position P3, and no further gravitational energy is stored. During the first portion of the in-stroke L3, the apparatus 20 rotates and displacement of the axis of axle 38 from the random surface 41 decreases until point P4 is reached, returning stored gravitational energy. During the final portion of the in-stroke L4 (e.g., with the orientation of the apparatus 20 as shown in FIG. 2), rotational of the apparatus 20 and further displacement of the axis of axle 38 towards the random surface ceases. Advantageously, a second cycle can begin from point P1 (or other nearby point) without any adjustment being made to the horizontal or position or rotational orientation of the apparatus 20, as the stroke portions L1 and L3, wherein energy is stored and returned respectively, are constant in length regardless of starting position, while stroke portions L2 and L4 vary when S-max is varied. While L1, L3 have been shown as horizontal lines in FIG. 6, other non-horizontal profiles may be used (also, the weight supported by the handles during an exercise cycle is not constant); however, L2 and L4 are always horizontal and zero.

Figure 7:
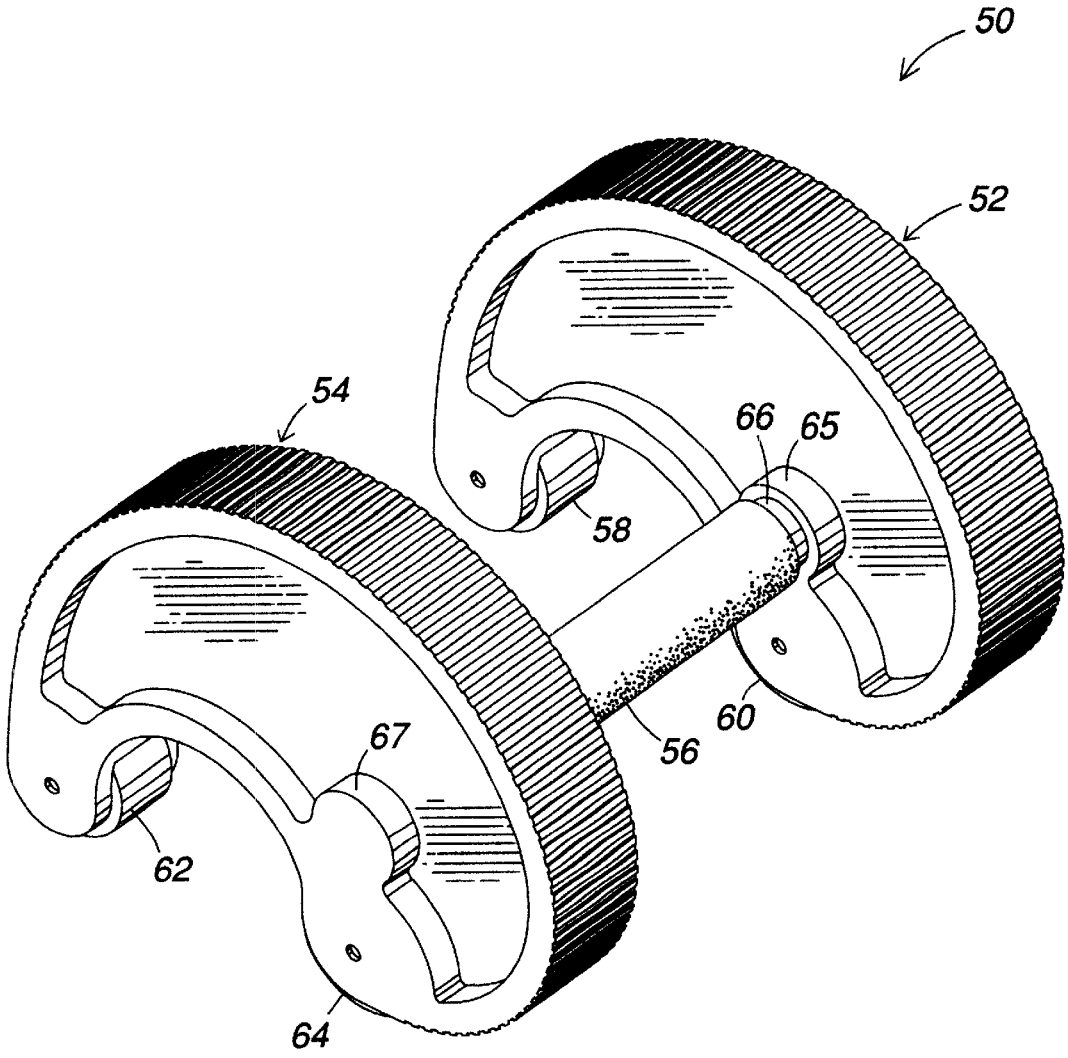
FIG. 7 is a perspective view of a double lobed cam action exercise apparatus of FIG. 1 according to one embodiment of the invention.

Turning now to FIG. 7, an embodiment with dual cam lobes segments 52, 54 is shown generally by numeral 50. A single handle 56 is provided for use with one or both hands of the operator. Handle 56 is free to rotate around shaft 66. Shaft 66 is rotationally fixed to hubs 65, 67, to provide a fixed rotational relationship of the cam lobe segments 52, 54. Irrotational translation of the apparatus 50 is provided for by rollers 58, 60, 62, 64. Rotation and translation of the apparatus is identical to the embodiment shown in FIGS. 2–4.

Figure 8:
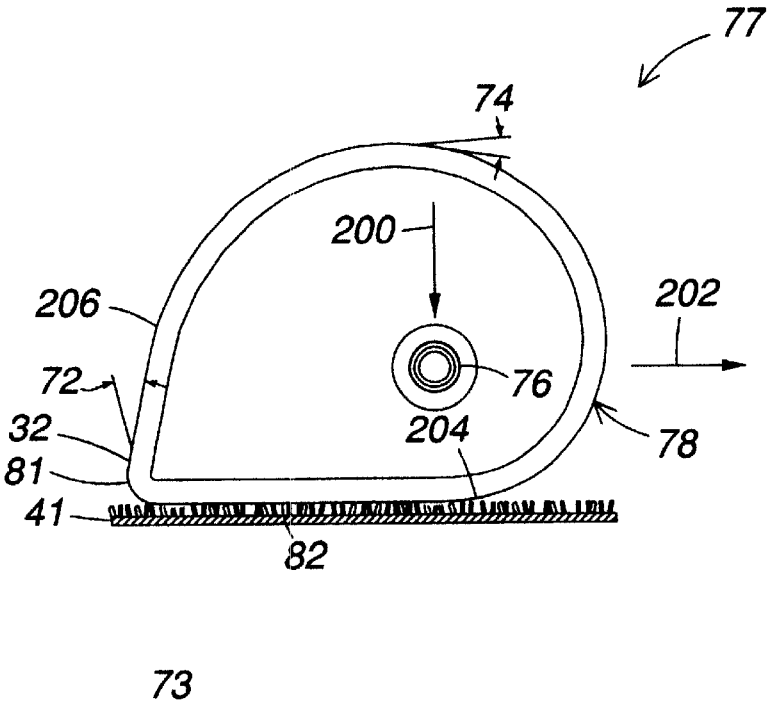
FIG. 8 is a side view of a cam action exercise apparatus according to one embodiment of the invention, with the apparatus shown in the initial position of the out-stroke.
Figure 9:
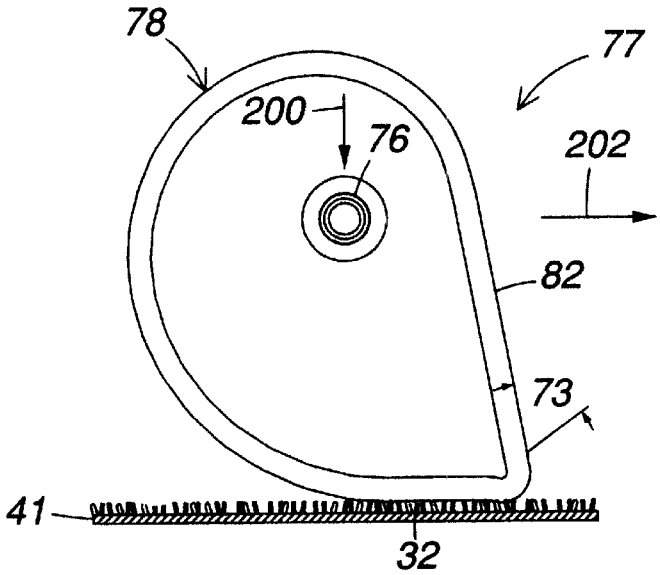
FIG. 9 is a side view of a cam action exercise apparatus shown in FIG. 8, with the apparatus shown in the final position of the out-stroke.

Turning now to FIG. 8, an alternative embodiment of the invention is shown generally as numeral 77. Outer cam surface 78 has a first portion having a characteristic angle 74 relative to the axis of handle 76 (i.e., the outer cam surface 78 forms a section of a ccw spiral between points 204 and 206.). Between point 206 and tail 81, the (increasing) characteristic angle 72 of slide portion 32 is greater than characteristic angle 74. Characteristic angle 72 is sufficiently great, and/or the coefficient of friction to random surface 41 of slide portion 32 sufficiently low so that apparatus 77 ceases to rotate when slide portion 32 comes into contact with random surface 41 (as shown in FIG. 9). Rotating apparatus 77 to this orientation shown in FIG. 9 results in subsequent irrotational translation. Similar results (not shown) occur when the apparatus is pulled in the direction opposite direction 202, as characteristic angle 73 (FIG. 9) of slide portion 82 (between tail 82 and point 206) is also sufficiently larger than characteristic angle 74, and/or the coefficient of friction to random surface 41 of slide portion 82 is sufficiently low, so that apparatus 77 then slides on random surface without rotation. Rotation and translation of the apparatus is identical to the embodiment shown in FIGS. 1–4, except that only sliding occurs, rather than the rolling action on rollers 24, 28, and sliding on slide surface 32. The use of rollers is preferred for use on hard or abrasive surfaces.

Figure 10:
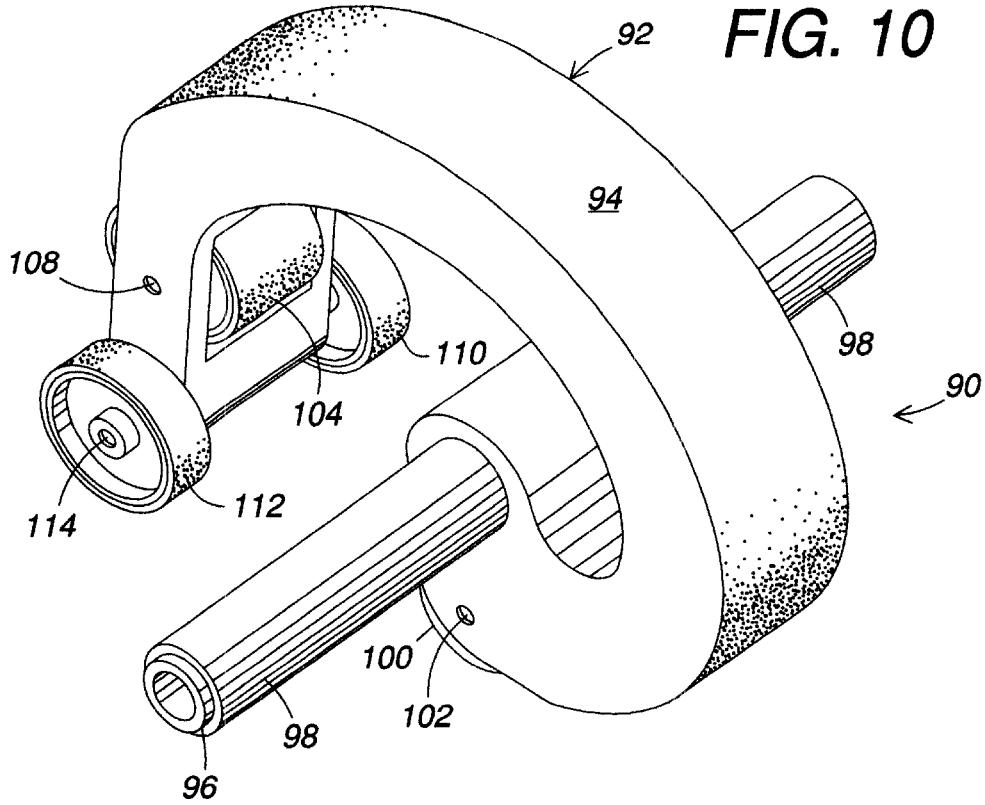
FIG. 10 is a perspective view of a cam action exercise apparatus according to a preferred embodiment of the invention.

Turning now to FIG. 10, an embodiment of the present invention is shown generally as numeral 90. Handles 98 are supported by shaft 96 rotatably mounted in cam lobe 92. Cam lobe 92 has outer friction surface 94, support roller 100 rotatably mounted on axle 102, support roller 104 rotatably mounted on axle 108, and outboard support rollers 110, 112, rotatably mounted on axle 114. Rotation and translation of apparatus 90 is identical to the embodiment shown in FIGS. 1–4, except that no sliding occurs, as roller 104 takes the place of slide surface 32 (FIG. 1), thereby allowing two-point support for both the in-stroke and the out-stroke. One-way clutches (not shown) may be used in one or more of rollers 100, 104, 110, 112 in this embodiment, or in any of the embodiments having rollers. Also, a traction belt (not shown) may be used to span two or more rollers to provide contact with the random surface in order to provide smoother performance.

Figure 11:
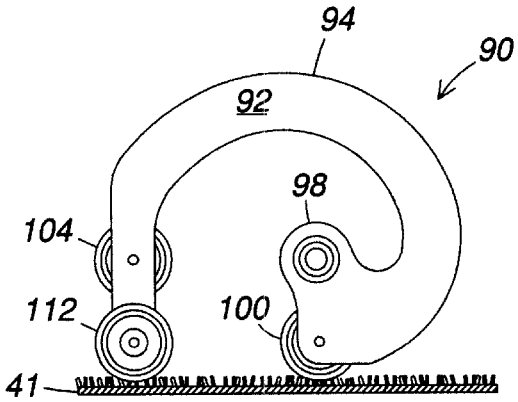
FIG. 11 is a side view of the cam action exercise apparatus shown in FIG. 10, with the apparatus in the semi-stable initial position of the kneel-prone out-stroke.
Figure 12:
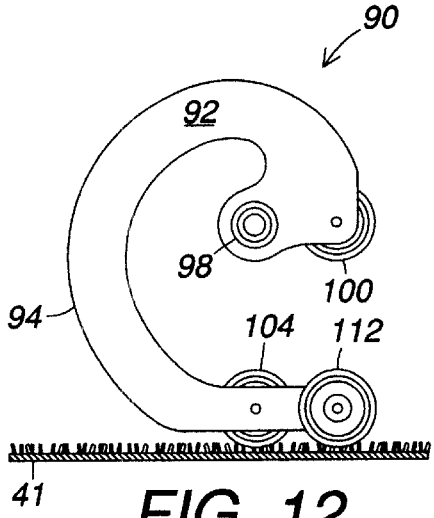
FIG. 12 is a side view of the cam action exercise apparatus shown in FIG. 10, with the apparatus in the semi-stable final position of the kneel-prone out-stroke.

In FIG. 11, the orientation of apparatus 90 for the first portion of the out-stroke and the final portion of the in-stroke is shown. In FIG. 12, the orientation of the apparatus 90 for the final portion of the out-stroke and the first portion of the in-stroke is shown. The cam lobe 92 is shown as a thin spiral section, thereby giving apparatus 90 compliance for absorbing shock during use.

Figure 13:
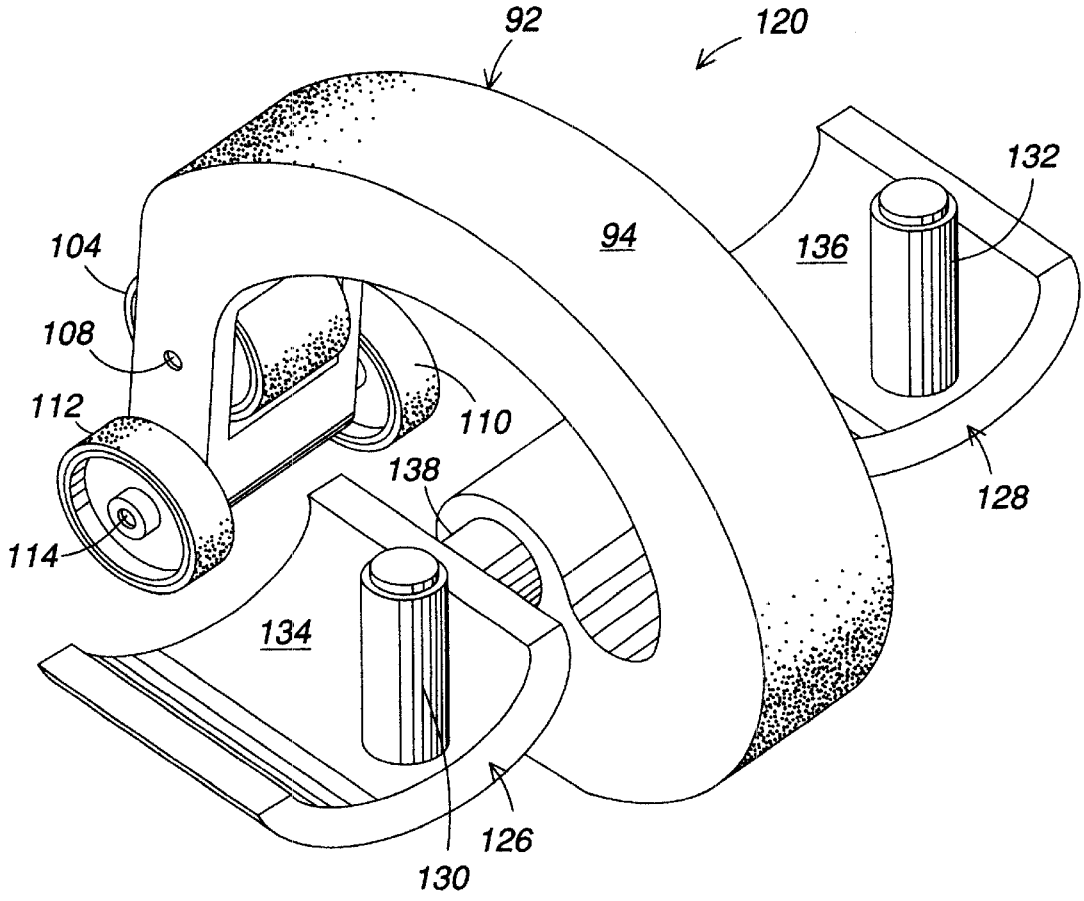
FIG. 13 is a perspective view of a cam action exercise apparatus having wrist supports, according to an alternative embodiment of the invention.

Turning now to FIG. 13, an alternative embodiment of the present invention is shown generally as numeral 120. The handles 98 of apparatus 90 (FIG. 10) have here been replaced with cradles 126, 128, which comprise wrist/arm supports 134, 136 and handholds 130, 132.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

I claim:

1. An exercise apparatus for use with a random surface, comprising:

a wheel having a first axis and a first outer surface, wherein said first outer surface is engageable with the random surface so as to rotate about said first axis, and wherein said first axis has a varying vertical displacement from the random surface during rotation of said wheel when said first outer surface is in contact with the random surface and said first axis is parallel to said random surface;

a shaft extending along said first axis;

at least one hand support mounted to said shaft and rotatable relative to said wheel; and a first roller having a second outer surface, said first roller rotatably fixed to said wheel, said first roller having a second axis not coincident with said first axis, wherein at least a portion of said second outer surface extends beyond said first outer surface, whereby rotation of said wheel about said first axis is substantially stopped when said second outer surface contacts the random surface during use.

2. An exercise apparatus for use with a random surface, as recited in claim 1, wherein said wheel is comprised of a plurality of wheel segments spaced along said first axis, and wherein said wheel segments are in a fixed rotational relationship.

3. An exercise apparatus for use with a random surface, as recited in claim 1, wherein said wheel is comprised of first and second wheel segments spaced along said first axis, and wherein said first and second wheel segments are in a fixed in-phase rotational relationship.

4. An exercise apparatus for use with a random surface, as recited in claim 3, wherein said shaft extends between said first and said second wheel segments and is irrotatably fixed to said first and said second wheel segments.

5. An exercise apparatus for use with a random surface, as recited in claim 1, wherein said vertical displacement increases by at least 10% as said wheel is rotated through an exercise angle about said first axis, wherein said exercise angle is in the range of about 90 degrees to less than 360 degrees.

6. An exercise apparatus for use with a random surface, as recited in claim 1, wherein said vertical displacement increases by at least 50% as said wheel is rotated through an exercise angle about said first axis, wherein said exercise angle is in the range of 90 degrees to less than 360 degrees.

7. An exercise apparatus for use with a random surface, as recited in claim 1, wherein said vertical displacement increases continuously as said wheel is rotated through an exercise angle about said first axis, wherein said exercise angle is in the range of 90 degrees to less than 360 degrees.

8. An exercise apparatus for use with a random surface, as recited in claim 1, further comprising:

a second roller having a third outer surface, said second roller rotatably fixed to said wheel, said second roller having a third axis not coincident with said first axis, wherein at least a portion of said third outer surface extends beyond said first outer surface.

9. An exercise apparatus for performing an exercise comprising kneel-prone and prone-kneel strokes with a random surface, comprising:

a first wheel having an first axis and a first outer surface, wherein said first outer surface is rotatably engageable with the random surface, wherein said first axis has an increasing vertical displacement from the random surface during a rotation through a rotation angle of at least 90 degrees in a first rotational direction of said first roller when said first outer surface is in contact with the random surface, and said first axis is parallel to the random surface;

a shaft extending along said first axis and through said first wheel;

at least a first handle mounted to said shaft and rotatable relative to said first wheel; and a first projection from said first outer surface whereby said projection prevents said first roller from rotating about said first axis when said first wheel is rotated in contact with the random surface, so that said first wheel is limited to a rotation of less than 360 degrees during either the kneel-prone or prone-kneel strokes.

10. An exercise apparatus for performing an exercise comprising kneel-prone and prone-kneel strokes with a random surface, as recited in claim 9, further comprising a second handle mounted to said shaft so that said first wheel is between said first handle and said second handle.

11. An exercise apparatus for performing an exercise comprising kneel-prone and prone-kneel strokes with a random surface, as recited in claim 10, wherein:

said first handle comprises a first wrist and/or arm rest; and said second handle comprises a second wrist and/or arm rest.

12. An exercise apparatus for performing an exercise comprising kneel-prone and prone-kneel strokes with a random surface, as recited in claim 9, further comprising a second wheel substantially identical to said first wheel, wherein said second wheel is rotatably fixed relative to said first wheel.

13. An exercise apparatus for performing an exercise comprising kneel-prone and prone-kneel strokes with a random surface, as recited in claim 12, wherein said first handle is located between said first wheel and said second wheel along said first axis.

14. A kneel-prone-kneel exercise apparatus for use on a random surface by an operator for performing an exercise having kneel-prone and prone-kneel strokes, comprising:

a first wheel having an first axis and a first outer surface, wherein said first axis has an increasing vertical displacement from the random surface during a rotation through an exercise angle of said first wheel in a first rotational direction of said first wheel when said first outer surface is in contact with the random surface, and said first axis is parallel to the random surface;

grip means for one or both hands of the operator, rotatably attached about said first axis to said first wheel;

wherein the kneel-prone stroke has a first kneel-prone translational portion wherein said first outer surface rotates and said vertical displacement of said first axis from the random surface increases so that gravitational energy is stored thereby, and a second kneel-prone translational portion subsequent to said first kneel-prone translational portion wherein said first outer surface is substantially irrotational and said vertical displacement is substantially unchanged; and wherein the prone-kneel stroke has a first prone-kneel translational portion wherein said outer surface rotates and said vertical displacement of said first axis from the random surface decreases so that gravitational energy is released thereby, and a second prone-kneel translational portion subsequent to said first prone-kneel translational portion wherein said outer surface is substantially irrotational and said vertical displacement is substantially unchanged.

15. A kneel-prone-kneel exercise apparatus for use on a random surface by an operator for performing an exercise having kneel-prone and prone-kneel strokes, as recited in claim 14, wherein said vertical displacement increases by at least 10% during said first kneel-prone translational portion, and wherein said exercise angle is in the range of about 90 degrees to less than 360 degrees.

16. A kneel-prone-kneel exercise apparatus for use on a random surface by an operator for performing an exercise having kneel-prone and prone-kneel strokes, as recited in claim 14, wherein said vertical displacement increases by at least about 50% during said first kneel-prone translational portion, and wherein said exercise angle is approximately 270 degrees.

17. A kneel-prone-kneel exercise apparatus for use on a random surface by an operator for performing an exercise having kneel-prone and prone-kneel strokes, as recited in claim 14, further comprising a first roller having a second outer surface, said first roller rotatably fixed to said wheel, said first roller having a second axis not coincident with said first axis, wherein at least a portion of said second outer surface extends beyond said first outer surface, whereby rotation of said wheel about said first axis is substantially stopped when said second outer surface contacts the random surface during use.

18. A kneel-prone-kneel exercise apparatus for use on a random surface by an operator for performing an exercise having kneel-prone and prone-kneel strokes, as recited in claim 14, further comprising a first projection having a characteristic angle sufficiently large to prevent rotation of said wheel when said first projection is rotated into contact with the random surface during use.

19. A kneel-prone-kneel exercise apparatus for use on a random surface by an operator for performing an exercise having kneel-prone and prone-kneel strokes, as recited in claim 18, wherein said first projection comprises a first roller having a second outer surface, said first roller rotatably fixed to said wheel, said first roller having a second axis not coincident with said first axis, wherein at least a portion of said second outer surface extends beyond said first outer surface.

20. A bi-directional exercise apparatus for employment by a operator in forward and reverse directions while in contact with a random surface, comprising:

a first wheel having a first rotational axis, said first wheel comprising a cam surface for contact with the supporting surface;

a grip for one or both hands of the operator, rotatably attached to said first wheel at said first rotational axis;

a first portion of said cam surface, wherein said cam surface slips or rolls on the supporting surface without rotation of said first wheel about said first rotational axis when said first wheel is employed in the forward direction, and wherein said cam surface grips the random surface and rotates about said first rotational axis when said first wheel is employed in the reverse direction;

a second portion of said cam surface, wherein said cam surface slips or rolls on the supporting surface without rotation of said first wheel about said first rotational axis when said first wheel is employed in the reverse direction, and wherein said cam surface grips the random surface and rotates about said first rotational axis when said first wheel is employed in the forward direction; and a third portion of said cam surface between said first portion and said second portion, wherein said cam surface grips the random surface and rotates about said first rotational axis when used in either the reverse or forward directions; and wherein said first rotational axis has a vertical displacement from the random surface when said first rotational axis is parallel to the random surface, wherein said vertical surface varies from a first value to a different second value during rotation about said first rotational axis within said third portion.

21. A bi-directional exercise apparatus for employment by a operator in forward and reverse directions while in contact with a random surface, as recited in claim 20, wherein said second value is at least 10% greater than said first value.

22. A bi-directional exercise apparatus for employment by a operator in forward and reverse directions while in contact with a random surface, as recited in claim 20, wherein said second value is at least 50% greater than said first value.

23. A bi-directional exercise apparatus for employment by a operator in forward and reverse directions while in contact with a random surface, as recited in claim 20, wherein said third portion of said cam surface comprises more than about 90 degrees and less than about 270 degrees of said cam surface.

24. A method for exercising by an operator, comprising the steps of:

(a) providing a wheel in contact with a random surface, wherein said wheel comprises a peripheral surface for contact with said random support surface, an axis having a vertical displacement from said random surface when said axis is parallel to said random surface, and at least one handle rotatably attached to said axis;

(b) grasping said at least one handle with at least one hand of the operator while the operator is in a kneeling position;

(c) pushing said wheel away from the operator with a kneel-prone stroke so that said kneel-prone stroke has a first portion wherein said wheel translates along said random surface by rotating about said axis, and a second portion wherein said wheel translates along said random surface without rotation about said axis, and wherein said vertical displacement is greater during said second portion than said first portion; and (d) pulling said wheel towards said operator with a prone-kneel stroke so that said prone-kneel stroke has a third portion wherein said wheel translates along said random surface by rotating about said axis, and a fourth portion wherein said wheel translates along said random surface without rotation about said axis, and wherein said vertical displacement is greater during said third portion than said fourth portion;

whereby the difficulty of performing step (d) by the operator is eased.

25. A method for exercising by an operator, as recited in claim 24, wherein said vertical displacement has a minimum during said first portion, and said vertical displacement during said second portion is greater than said minimum by at least 10%, and wherein said vertical displacement has said minimum during said fourth portion, and said vertical displacement during said third portion is greater than said minimum by at least 10%.

26. A method for exercising by an operator, as recited in claim 24, wherein said wheel rotates by an first angle having an absolute value of more than 90 degrees and less than 300 degrees during said kneel-prone stroke and wherein said wheel rotates by a second angle having an absolute value of more than 90 degrees and less than 300 degrees during said prone-kneel stroke.

27. A method for exercising by an operator, as recited in claim 26, wherein said, first angle is equal to said second angle.

* * * * *